US005188226A

United States Patent [19]

Platt

[11] Patent Number: 5,188,226

[45] Date of Patent: Feb. 23, 1993

[54] MULTIPLE PRODUCT CONTAINER CARTON

[75] Inventor: Ronald Platt, Chicago, Ill.

[73] Assignee: The Packaging House, Inc., Chicago, Ill.

[21] Appl. No.: 883,943

[22] Filed: May 14, 1992

[51] Int. Cl.[5] ..... B65D 75/00

[52] U.S. Cl. ..... 206/153; 206/152; 206/154; 206/429; 229/40; 53/443; 53/441; 53/452

[58] Field of Search ..... 206/149, 140, 152, 154, 206/155, 199, 427, 429, 497; 229/40; 53/443, 450, 452, 458, 441

[56] References Cited

U.S. PATENT DOCUMENTS

| | | | |
|---|---|---|---|
| 2,331,038 | 10/1943 | Meller | 206/429 |
| 2,738,055 | 3/1956 | Shanahan | 229/40 |
| 2,854,183 | 9/1958 | Srofe | 206/149 |
| 2,912,103 | 11/1959 | Hennessey et al. | 206/429 |
| 3,078,988 | 2/1963 | Dunning | 206/429 |
| 3,302,784 | 2/1967 | Copping | 206/153 |
| 3,503,498 | 3/1970 | Lawrence | 206/152 |
| 3,604,560 | 9/1971 | Farquhar | 229/40 |
| 3,674,136 | 7/1972 | Forrer | 206/153 |
| 3,701,416 | 10/1972 | Lawrence | 206/153 |
| 3,987,897 | 10/1976 | Smith | 206/497 |
| 4,732,316 | 3/1988 | Oliff et al. | 206/427 |
| 5,092,467 | 3/1992 | Elward | 229/40 |

*Primary Examiner*—David T. Fidei
*Attorney, Agent, or Firm*—Jones, Day, Reavis & Pogue

[57] ABSTRACT

A multiple product container carton having a rectangular base portion and substantially triangular side walls with opposing slots in the side walls for holding product containers. End walls are hingedly connected to the ends of the rectangular base portion and fold upwardly and lock to the side walls to securely hold the product containers in the carton. Perforation lines may extend between the opposing pairs of slots such that a product container may be removed from the carton by tearing along the perforation lines.

9 Claims, 8 Drawing Sheets

MULTIPLE PRODUCT CONTAINER CARTON

FIELD OF THE INVENTION

The present invention relates to paperboard cartons in general and in particular to a paperboard carton that can contain multiple product containers.

BACKGROUND OF THE INVENTION

There are many products sold today that are packaged in small containers. Further, these small containers may be of the plastic variety as well as glass. In packaging such small containers, there is frequently used a carton that can hold multiple ones of the small product containers so that they can be sold in various quantities in one package.

In such cases, the product containers must be securely held within the carton and in many cases a carton sleeve is formed which substantially surrounds the multiple product containers. In such instances, of course, it is quite expensive to extend the paperboard completely around the product containers so as to securely hold them. Thus, the packaging costs are increased with this type of carton.

The present invention relates to a multiple product container carton that has an elongated rectangular base portion with substantially triangular shaped opposing side walls hingedly connected to, integrally formed with and coterminous with the outer edges of the base portion. Multiple slots are formed in that portion of each triangular side wall facing the opposing side wall such that each opposing pair of slots receives a first portion of a product container therein. End flaps are hingedly connected to the rectangular base portion which are so constructed as to engage slots formed in the upper edges of the triangular shaped side walls, thus locking the end flaps in position and locking the containers in the slots within the carton. Utilizing this type of package with shrink wrap film significantly decreases the amount of paperboard that would be required to completely overwrap the multiple product containers in a folding carton sleeve. Thus, significant savings occurs. In addition, perforation lines may extend across the carton perpendicular to the length of the carton and between the slots to enable a product container in the slots to be removed along the perforation lines from the remainder of the carton.

Thus, it is an object of the present invention to provide a multiple product container carton that has an elongated rectangular base portion with substantially triangular shaped opposing side walls and having an outer edge hingedly connected to, integrally formed with and coterminous with the outer edges of the base portion. Multiple slots are formed in that portion of each triangular side wall facing the opposing side wall such that each opposing pair of slots receives a first portion of a product container therein. An end wall is hingedly attached to each end of the carton with means on the end walls and means on the side walls of the carton for latching the end walls in place when they are pivoted upwardly about the hinge line connecting them to the carton.

SUMMARY OF THE INVENTION

Thus, the invention relates to a multiple product container carton comprising an elongated rectangular base portion, substantially triangular shaped opposing side walls having an outer edge hingedly connected to, integrally formed with and coterminous with the outer edges of the base portion, multiple slots formed in that portion of each triangular side wall facing the opposing side wall such that each opposing pair of slots receives a first portion of a product container therein, an end wall hingedly attached to each end of the carton, each end wall having a downwardly facing notch on each side thereof formed by downwardly extending arms, and a corresponding upwardly facing notch formed inwardly of each end of each triangular shaped side wall such that folding said end walls upwardly enables the end wall notches to engage corresponding side wall notches to lock the end walls in their upward position, thereby forming a multiple product container carton.

The invention also relates to a method of forming a multiple product container carton comprising the steps of integrally forming substantially triangular shaped opposing side walls with the outer edges of an elongated rectangular base portion, forming multiple slots in that portion of each triangular side wall facing the opposing side wall such that each opposing pair of slots receives a first portion of a product container therein, hingedly attaching an end wall to each end of the carton, each end wall having a downwardly facing notch on each side thereof formed by downwardly extending arms, forming a corresponding upwardly facing notch inwardly of each end of each triangular shaped side wall such that folding the end walls upwardly enables the end wall notches to engage corresponding side wall notches to lock the end walls in their upward position, thereby forming a multiple product container carton, and encasing the entire carton and the multiple product containers in a shrink wrap plastic film to form a unitary product.

BRIEF DESCRIPTION OF THE DRAWINGS

These and other objects of the present invention will be more fully understood in conjunction with a detailed description of the accompanying drawings in which like numbers indicate like components and in which.

DETAILED DESCRIPTION OF THE DRAWINGS

Figure 1:
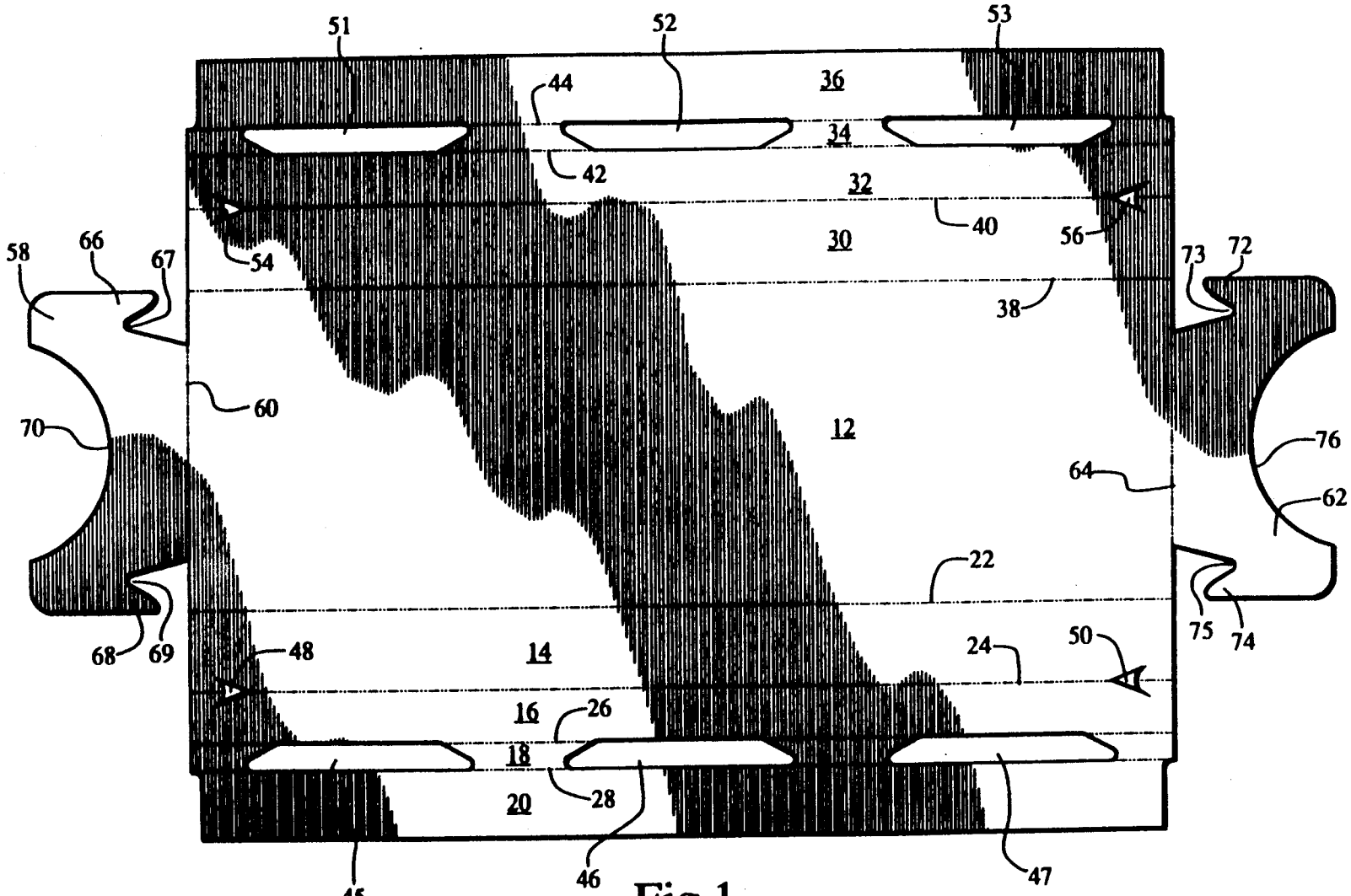
FIG. 1 is a plan view of the carton blank of the preferred embodiment of the present invention.

The novel carton blank of the present invention in its preferred embodiment is illustrated in FIG. 1. It includes an elongated rectangular base portion 12 with substantially rectangular panels 14, 16, 18 and 20 hingedly connected to the rectangular base portion 12 and to each other along respective score lines 22, 24, 26 and 28. On the other side of the rectangular base portion 12, substantially rectangular panels 30, 32, 34 and 36 are all connected to each other and to the base portion 12 along respective score lines 38, 40, 42 and 44. Multiple spaced slots 45, 46 and 47 are formed in side wall panel 18 and corresponding spaced multiple slots 51, 52 and 53 are formed in panel 34. Triangular shaped notches 48 and 50 are formed along score line 24 inwardly of the end edges 60 and 64. In like manner, triangular shaped slots 54 and 56 are formed along score line 40 inwardly of the end edges 60 and 64. End wall 58 is connected to one end of the elongated rectangular base portion 12 by score line 60 while end wall 62 is connected to the other end of the elongated rectangular base portion 12 along score line 64. End wall 58 has downwardly projecting arms 66 and 68 on each side thereof to form slots 67 and 69. An arcuate section 70 forms the outer edge of the end wall 58. In like manner, a second end wall 62 has downwardly extending arms 72 and 74 to form slots 73 and 75. Also end wall 62 has an arcuate outer edge 76.

Figure 2:
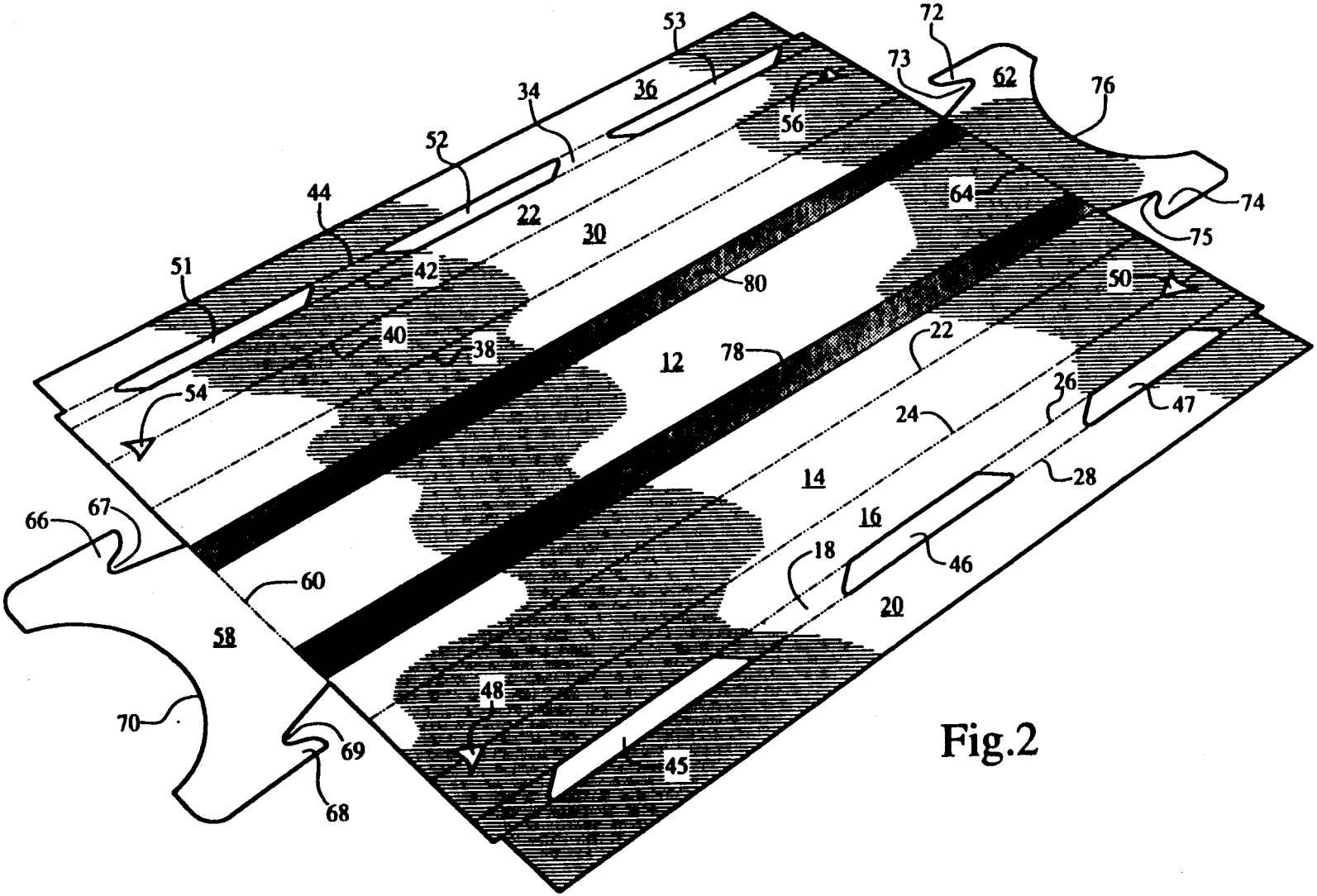
FIG. 2 is an isometric view of the novel carton blank prepared for folding to form the multiple product carton.

The novel blank is illustrated in a perspective view in FIG. 2 prior to its being folded. It has glue strips 78 and 80 placed thereon.

Figure 3:
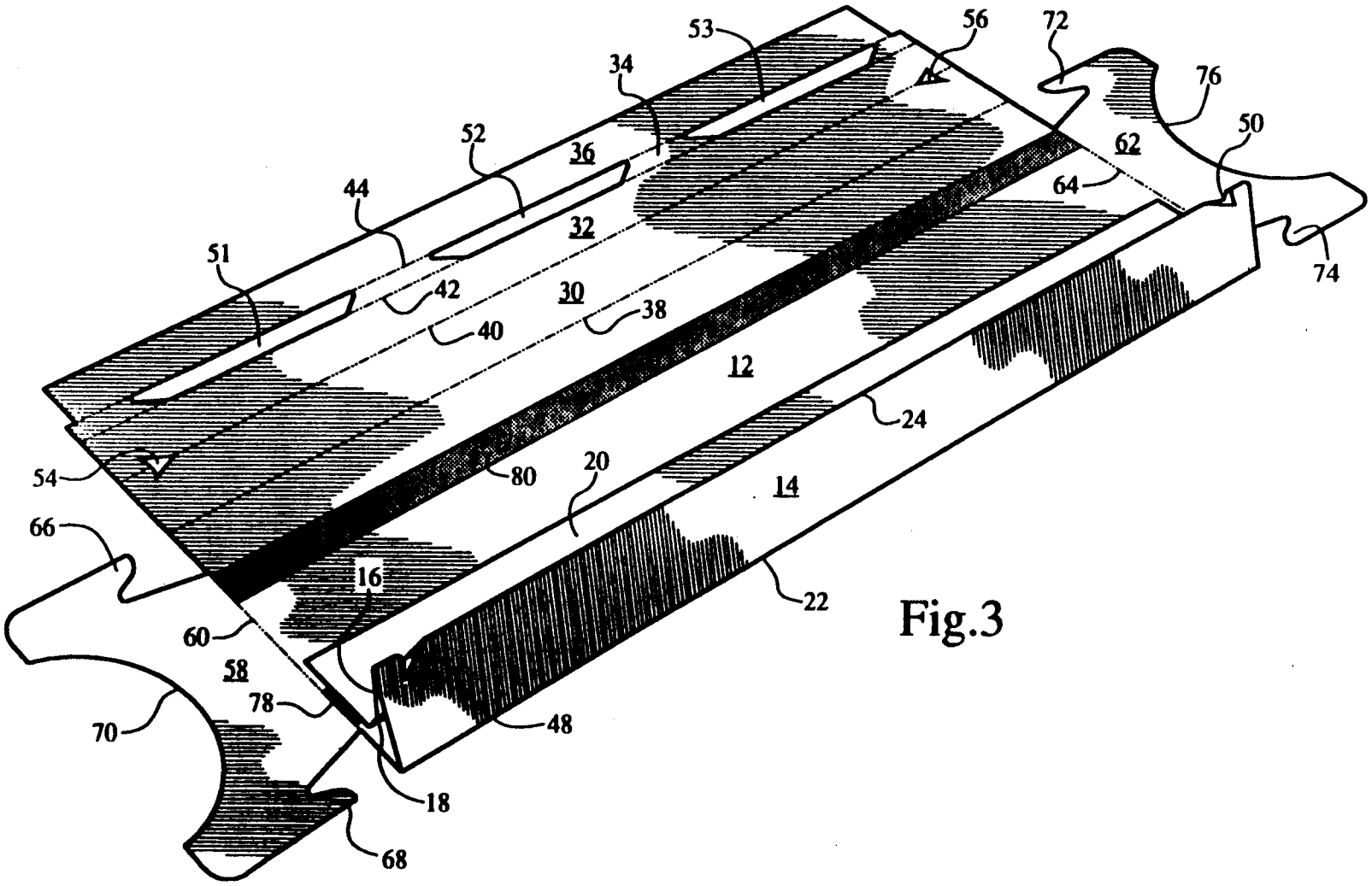
FIG. 3 is an isometric view of the product carton blank partially folded to form one of the substantially triangular sides of the carton.

In FIG. 3, the carton blank is illustrated partially folded. Outer panels 14, 16, 18 and 20 have been folded upwardly about score line 22 and then panels 16, 18 and 20 have been folded downwardly about score line 24. Outer panel 20 has been affixed to the glue strip 78 so as to form a substantially triangular shaped side wall as can be seen more clearly in FIG. 7. The glue strip 78 may be placed on the rectangular base portion 12 a sufficient distance away from the outer edge 22 of the base portion 12 such that, as shown in FIGS. 15A and 15B, when the outer panel 20 is adhered thereto the triangular side wall formed thereby cannot be folded inwardly about the outer edge 22 to a flat horizontal position. If such an attempt is made, and the glue strip 78 is properly placed as can be seen more clearly in FIG. 15B, the panel 18 would lie flat against the base 12 and, since the panel 14 is longer than the panel 16, the wall 14 could not be folded to a flat position.

However, if the glue strip 78 is placed on the rectangular base portion 12 sufficiently close to the outer edge 22 as shown in FIGS. 14A, B and C, then, by the time panel 18 is flat against the base 12, the panel 16 will be folded past the 45° point, thus allowing panel 14 to be folded flat against surface 12. Thus, the carton can be constructed such that it can be folded flat or prevented from being folded flat, depending upon where the glue lines 78 and 80 are placed.

Figure 4:
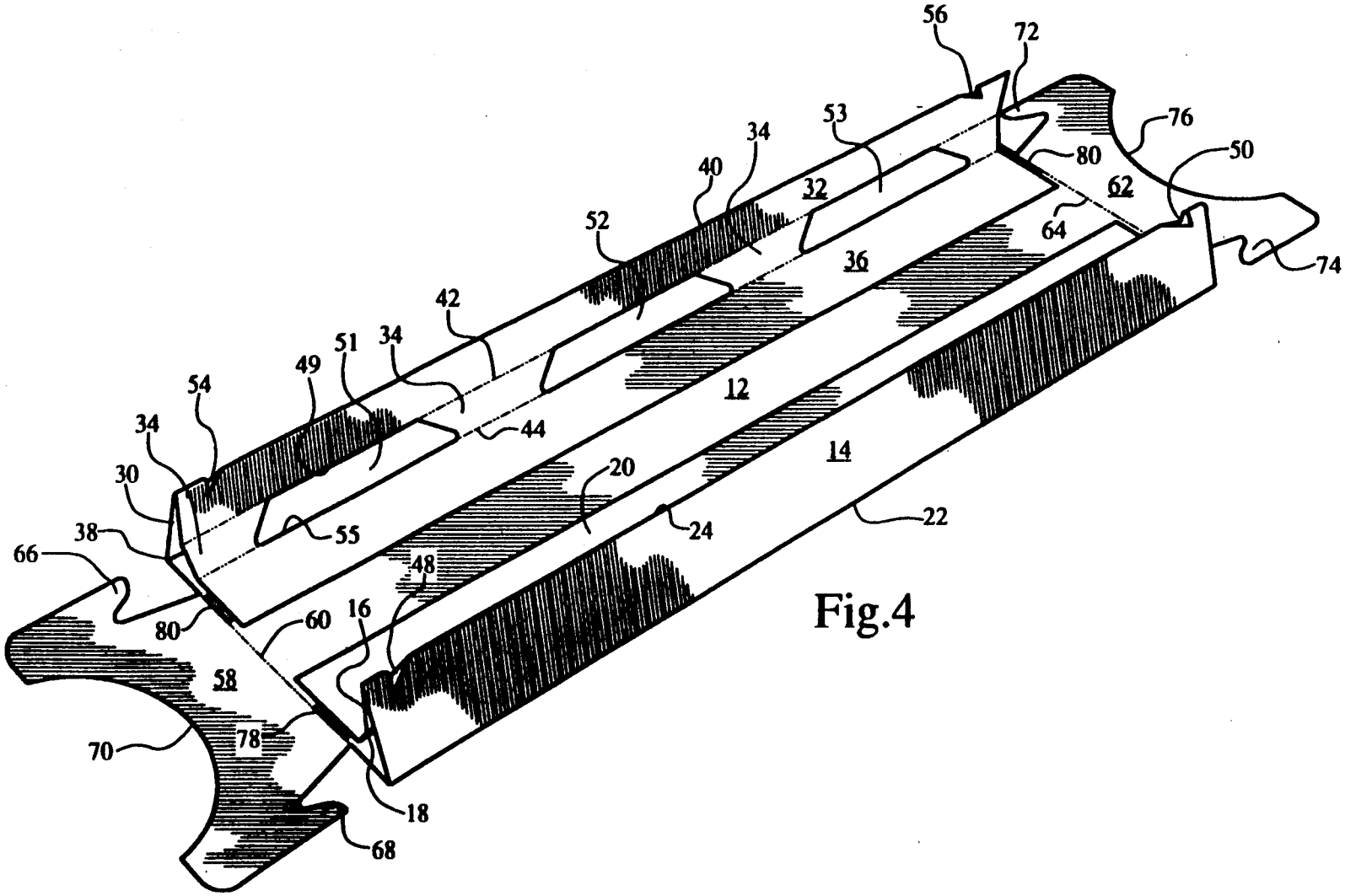
FIG. 4 is an isometric view of the novel carton blank partially folded to form both of the substantially triangular side walls.

In FIG. 4, both of the triangular sides of the carton have been erected. The outer panels 30, 32, 34 and 36 have been folded upwardly about score line 38 and panel 36 has been adhered to the glue strip 80. Again, the glue strip 80 may be placed on the rectangular base portion 12 a sufficient distance away from the outer edge 38 of the base portion 12 such that when the panel 36 is adhered thereto the triangular side walls cannot be folded inwardly about the outer edge 38 to a flat horizontal position as illustrated in FIGS. 15A and B. However, the glue strip may be placed on the rectangular base portion 12 sufficiently close to the outer edge 38 of the base portion 12 such that when the panel 36 is adhered to the base portion 12, the substantially triangular side walls can be folded inwardly about score lines 38 and 42 to a flat horizontal position as illustrated in FIGS. 14A, B and C.

Figures 5, 6:
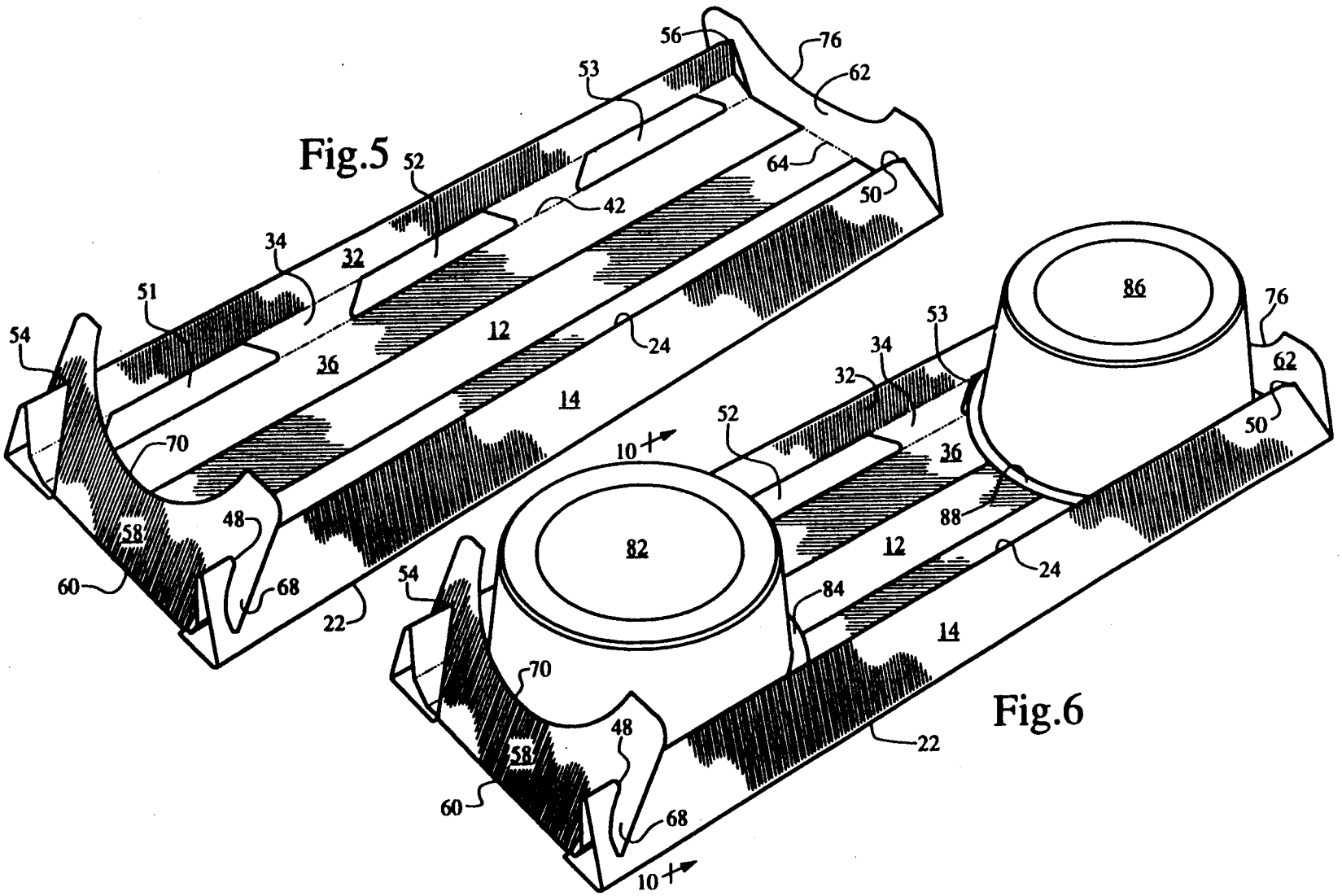
FIG. 5 is an isometric view of the completely folded carton with the end walls folded upwardly and locked in place.
FIG. 6 is an isometric view of the folded carton illustrating two product containers placed therein with room for a third container to be added.

In FIG. 5, the end walls 58 and 62 have been folded upwardly about their respective score lines 60 and 64. Each end wall has downwardly facing notches 67, 69 and 73, 75, respectively, as shown in FIGS. 1 and 2. Thus, the notches 67 and 69 of end wall 58 engage notches 48 and 54 in the triangular shaped side walls as illustrated in FIG. 5 and thus lock end wall 58 in position. In like manner, end wall 62 has notches 73 and 75 which engage notches 50 and 56 in the upper portion of the triangular side wall, thus latching end wall 62 in position. Multiple slots 45, 46 and 47 and 51, 52 and 53 are formed in the respective triangular side walls. These slots form opposing pairs to receive a first portion of a product container therein. It will be noted that that portion of the triangular shaped side wall facing the opposing triangular shaped side wall comprises a first upper panel 32 and a second lower panel 34 hingedly connected to the first panel 32. In like manner, on the opposite side wall, first upper panel 16 is hingedly coupled to second lower panel 18 by hinge line 26. This enables the first upper panel 32 and the second lower panel 34 to bend with respect to each other along the adjoining hinge connection 42 a predetermined amount. It will be noted in FIG. 4 that each of the slots 45, 46, 47 and 51, 52, 53 have an upper edge 49 and a lower edge 55 that is longer than the upper edge 49 to allow the lower portion of each slot to receive the first portion of a product container having a first width and the upper portion of the slot to receive a second portion of the product container of a second smaller width to thereby enable a portion of the triangular side wall to encircle the second portion of the product container and provide rigid support of the product container.

FIG. 5 illustrates the novel carton in its completed state.

FIG. 6 illustrates the completed carton holding two product containers 82 and 86. Note that product container 86 has a lower portion 88 inserted in slot 53. Although it cannot be seen in FIG. 6, it will be understood that the lower portion 88 of the product carton 86 also extends into slot 47 of the opposite triangular shaped side wall. Product container 82 has a lower portion 84 that extends into slots 51 and 45 of the opposing substantially triangular side walls. A space is left in FIG. 6 for a third carton to be inserted therein. It can be seen in FIG. 6 that the arcuate portion 70 of end portion 58 partially surrounds and embraces the curved surface of the container 82. The same action occurs with the arcuate portion 76 of the other end portion 62.

Figure 7:
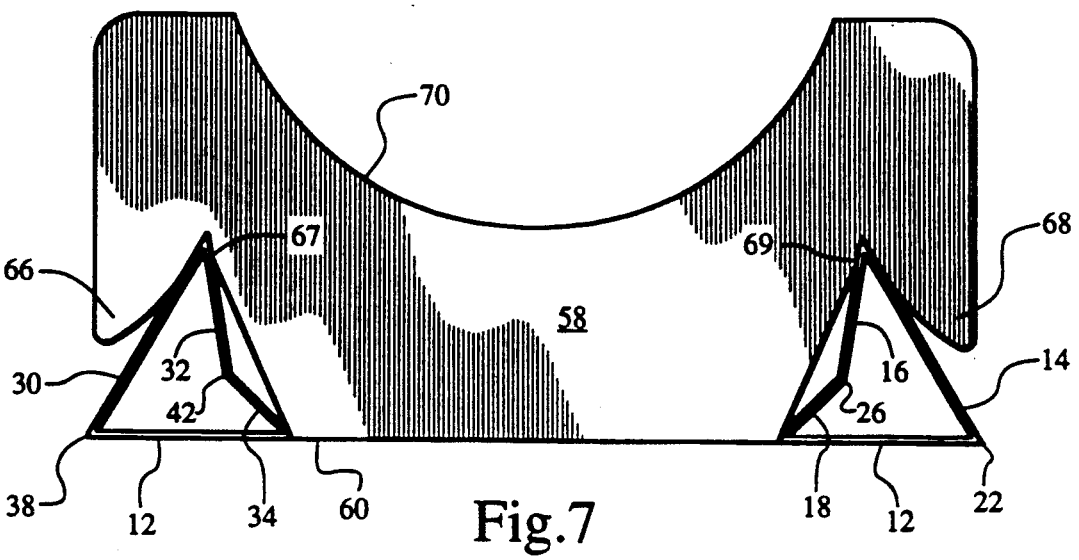
FIG. 7 is an end view of the novel product container.

FIG. 7 is an end view of the novel carton illustrating the substantially triangular shaped side wall portions formed of the base 12, panel 30, and panels 32 and 34. The other substantially triangular side wall is formed of the base 12, panel 14 and panels 16 and 18. The hinge portion 26 between panels 16 and 18 and the hinge portion 42 between panels 32 and 34 allow a small inward bending of the panels 32 and 34 and 16 and 18. This small bending, plus the fact that the top of the slots is smaller than the bottom of the slots, allows the panels 32 and 16 to substantially embrace the circular body portion of the product containers 82 and 86.

Figure 8:
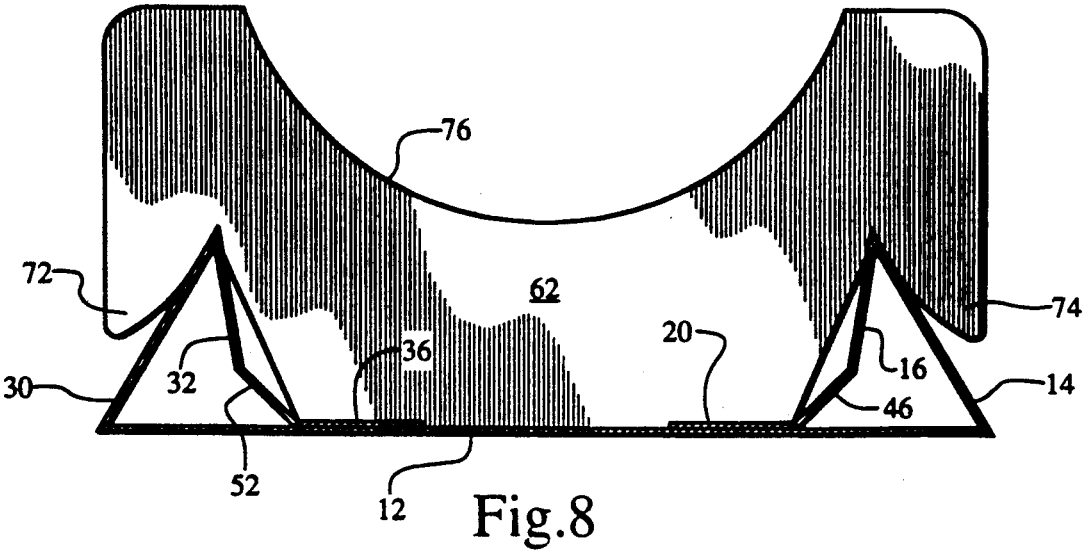
FIG. 8 is a cross-sectional view of the novel product container carton taken through the slots 52 and 46 in FIG. 5.

FIG. 8 is a cross-sectional view of the folded carton taken through slots 46 and 52. It illustrates the outer panels 20 and 36 on each side being adhered to the base 12 by the glue strips. It also shows the position of the slots 46 and 52 for receiving the bottom portions 84 or 88 of the product containers.

Figure 9:
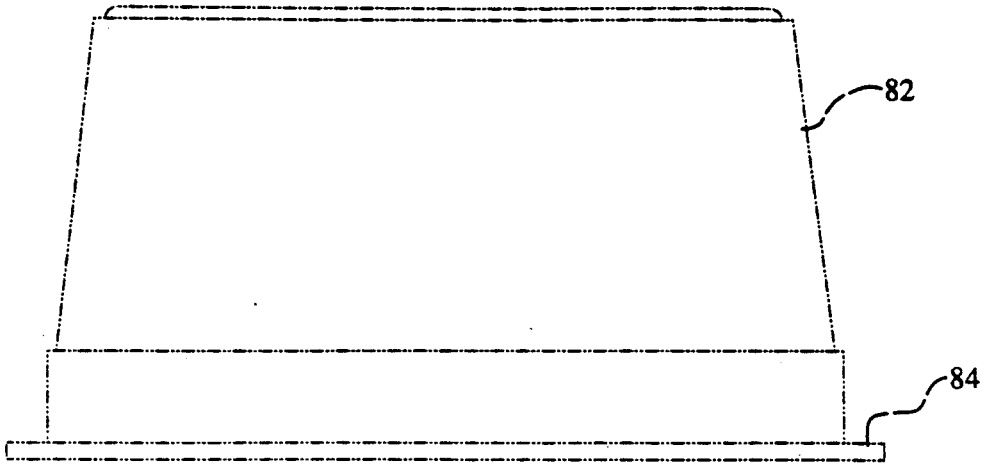
FIG. 9 is a phantom view of a product container to be inserted in the completed carton.

FIG. 9 illustrates in phantom lines a product container of the type which can be stored by the present carton. It has a body portion 82 which is substantially in the shape of a truncated cone and has a lower ledge 84 for insertion in the respective opposing slots in the triangular side walls.

Figure 10:
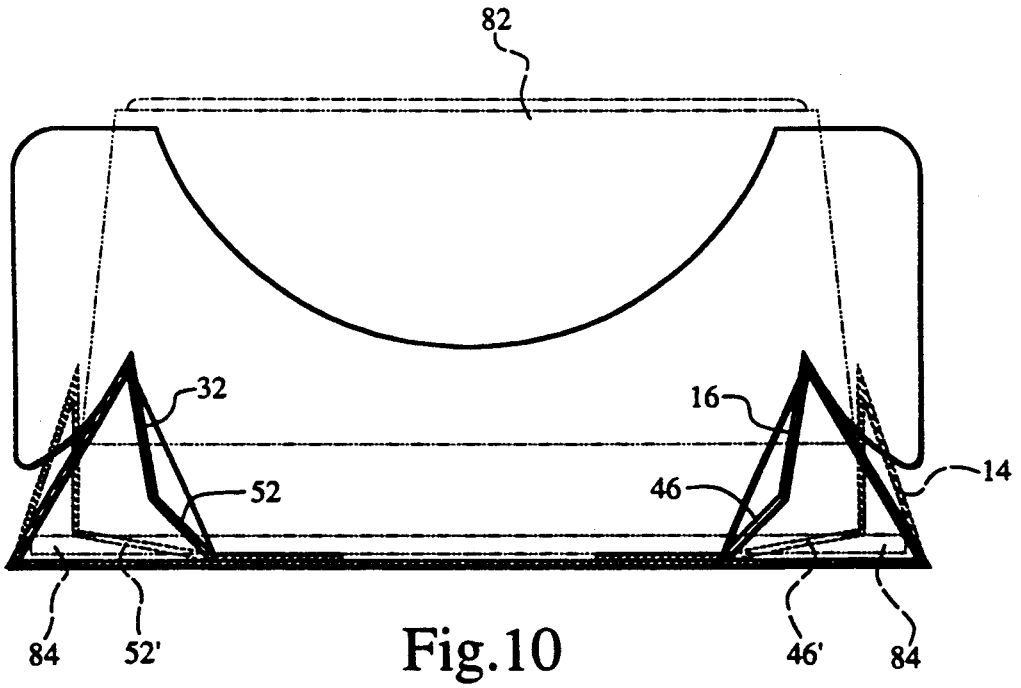
FIG. 10 is a cross-sectional view of the folded carton illustrating the product container, in phantom lines, inserted therein and illustrating the manner in which the substantially triangular shaped side walls conform to the product container.
Figure 13A:
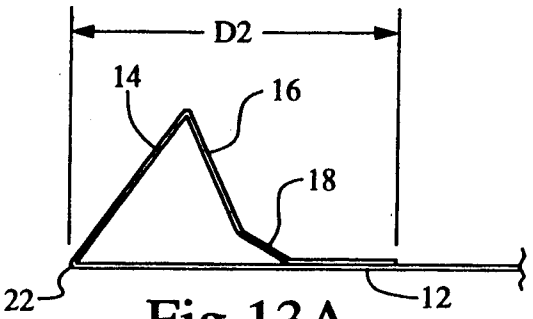
FIGS. 13A and B illustrate the placement of the glue strip such that the triangular shaped side walls cannot be folded to the flat state.
Figure 13B:
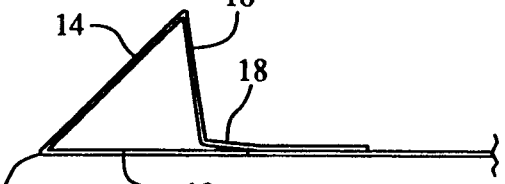
Figure 12A:
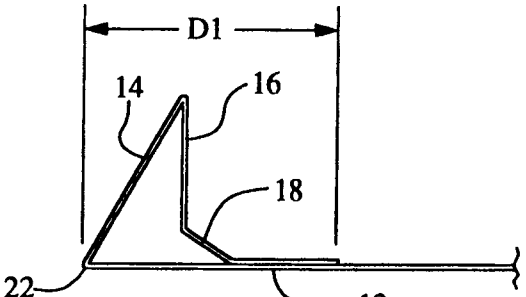
FIGS. 12A, B and C illustrate the placement of the glue strip such that the triangular shaped side walls can be folded flat.
Figure 12B:
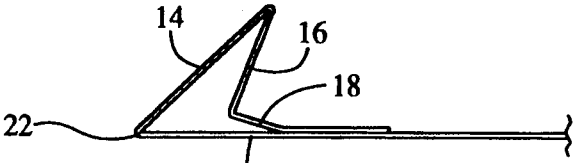
Figure 12C:
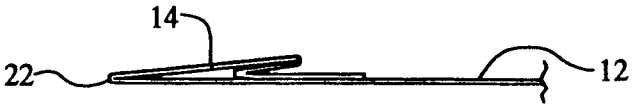

FIG. 10 illustrates how the product container, when inserted in the opposing slots of the carton, bends the side walls 16 and 18 and 32 and 34 slightly to securely hold the product container 82.

Figure 11:
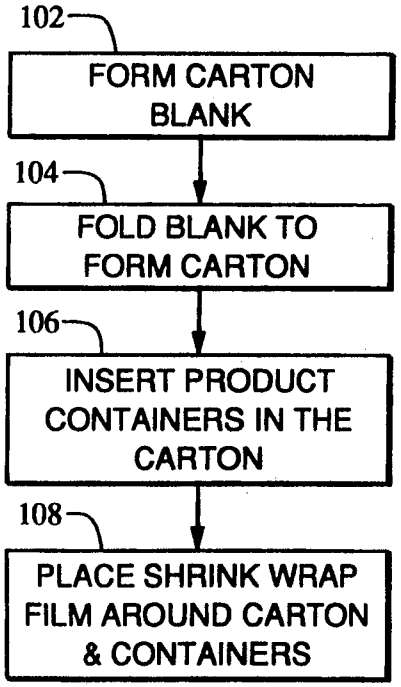
FIG. 11 is a flow process diagram illustrating the method of forming a unitary package including the carton and enclosed product containers that are enclosed in shrink wrap plastic.

FIG. 11 is a flow chart illustrating the method of the present invention in packaging the product containers in the carton. At step 102 the carton blank is formed as illustrated in FIG. 1. At step 2 the blank is folded to form the carton as illustrated in FIG. 5. At step 106, the containers are inserted in the carton as illustrated in FIG. 6. At step 108, shrink wrap film is placed around the carton and containers in a manner well-known in the art to form a unitary package including the carton and the product containers therein.

Thus, there has been disclosed a novel multiple product container carton in which the end flaps lock the containers into position and in which the glue flap may be glued such that the carton may or may not be folded flat when it is fully folded. Further, the package is completed by the use of shrink wrap film, thus decreasing the amount of paperboard that would be required to completely overwrap the three containers in a folding carton sleeve.

While the invention has been shown and described with respect to a particular embodiment thereof, this is for the purpose of illustration rather than limitation; other variations and modifications of the specific embodiment herein shown and described will be apparent to those skilled in the art all within the intended spirit and scope of the invention. Accordingly, the patent is not to be limited in scope and effect to the specific embodiment shown and described nor in any other way that is inconsistent with the extent to which the progress in the art has been advanced by the invention.

I claim:

1. A multiple product container carton comprising:

an elongated rectangular base portion;

substantially triangular shaped opposing side walls having an outer edge hingedly connected to, integrally formed with and coterminous with the outer edges of the base portion;

spaced multiple slots formed in that portion of each triangular side wall facing the opposing triangular side wall such that each opposing pair of slots receives a first portion of a product container therein;

an end wall hingedly attached to each end of the base portion, each end wall having a downwardly facing notch on each side thereof formed by downwardly extending arms; and a corresponding upwardly facing notch formed inwardly of each end of each triangular shaped side wall such that folding said end walls upwardly enables the end wall notches to engage corresponding side wall notches to lock said end walls in their upward position, thereby forming a multiple product container carton.

2. A carton as in claim 1 wherein that portion of the triangular shaped side wall facing the opposing triangular side wall comprises:

a first upper panel;

a second lower panel hingedly connected to the first panel; and a plurality of spaced slots in said second panel for receiving said product container portion therein.

3. A carton as in claim 2 wherein said first upper panel and said second lower panel can bend with respect to each other along their adjoining hinge connection a predetermined amount.

4. A carton as in claim 2 further including:

a third panel hingedly connected to said second panel; and a glue strip on said rectangular base portion for receiving said third panel so as to form said substantially triangular side walls.

5. A carton as in claim 4 wherein each of said multiple product container receiving slots comprises:

an upper edge; and a lower edge longer than the upper edge to allow each slot to receive said first portion of a product container having a first width and the upper portion to receive a second portion of the product container of a second smaller width to enable a portion of the triangular side wall to encircle said second portion of the product container and provide rigid support for the product container.

6. A carton as in claim 5 further including perforation lines extending across the carton perpendicular to the length of the carton and between the slots to enable a product container in the slots to be removed along the perforation lines from the remainder of the carton.

7. A carton as in claim 6 wherein said glue strip is placed on said rectangular base portion a sufficient distance away from the outer edge of said base portion such that when the third panel is adhered to the base portion, the triangular side walls cannot be folded inwardly about the outer edges to a flat horizontal position.

8. A carton as in claim 6 wherein the glue strip is placed on the rectangular base portion sufficiently close to the outer edges of the base portion such that when the third panel is adhered to the base portion, the triangular side walls can be folded inwardly about said outer edges to a flat horizontal position.

9. A method of forming a multiple product container carton comprising the steps of:

integrally forming substantially triangular shaped opposing side walls having an outer edge that is hingedly connected to and coterminous with the outer edges of an elongated rectangular base portion;

forming spaced multiple slots in that portion of each triangular side wall facing the opposing side wall such that each opposing pair of slots receives a first portion of a product container therein;

hingedly attaching an end wall to each end of the base portion, each end wall having a downwardly facing notch on each side thereof formed by downwardly extending arms;

forming a corresponding and upwardly facing notch inwardly of each end of each triangular shaped side wall such that folding said end walls upwardly enables the end wall notches to engage corresponding side wall notches to lock the end walls in their upward position, thereby forming a multiple product container carton;

inserting product containers in the spaced slots in said carton; and placing shrink wrap plastic film around the carton and the containers to form a unitary package.

* * * * *